United States Patent [19]

Berges et al.

[11] Patent Number: 5,066,202

[45] Date of Patent: Nov. 19, 1991

[54] METHOD AND APPARATUS FOR DELIVERING OIL TO A MULTI-STAGE PUMP

[75] Inventors: Hanns-Peter Berges, Cologne; Berthold Fischer, Erfstadt; Peter Mueller, Cologne; Dieter Vorberg, Erfstadt, all of Fed. Rep. of Germany

[73] Assignee: Leybold Aktiengesellschaft, Fed. Rep. of Germany

[21] Appl. No.: 533,535

[22] Filed: Jun. 5, 1990

[30] Foreign Application Priority Data

Jun. 6, 1989 [EP] European Pat. Off. ..... 89110196.6

[51] Int. Cl.[5] ..... F04C 39/04; F01C 21/04

[52] U.S. Cl. ..... 417/228; 417/205; 418/84; 418/87

[58] Field of Search ..... 417/228, 205; 418/84, 418/87

[56] References Cited

U.S. PATENT DOCUMENTS

| | | | |
|---|---|---|---|
| 2,779,533 | 1/1957 | Ziock . | |
| 3,395,856 | 8/1968 | Clark | 417/228 |
| 3,707,339 | 12/1972 | Budgen | 418/87 |
| 4,063,855 | 12/1977 | Paul . | |
| 4,383,802 | 5/1983 | Gianni | 418/87 |
| 4,605,357 | 8/1986 | Keith | 417/228 |

FOREIGN PATENT DOCUMENTS

| | | |
|---|---|---|
| 0228603 | 12/1970 | Fed. Rep. of Germany . |
| 3315748A1 | 10/1984 | Fed. Rep. of Germany . |
| 2854741 | 6/1988 | Fed. Rep. of Germany . |
| 3706583A1 | 9/1988 | Fed. Rep. of Germany . |

*Primary Examiner*—Richard A. Bertsch
*Assistant Examiner*—Alfred Basichas
*Attorney, Agent, or Firm*—Hill, Van Santen, Steadman & Simpson

[57] ABSTRACT

A method and apparatus for delivering oil into a pump chamber of a high-vacuum stage of a multi-stage pump. The method includes the steps of sensing a first pressure at an intake region of the high-vacuum stage of the pump, and sensing a second pressure at a discharge region of the high-vacuum stage of the pump. Oil is delivered to the high-vacuum stage of the pump in response to a pressure difference between the first and second pressures. Increased quantities of oil are delivered to the high-vacuum stage of the pump when the pressure difference exceeds a predetermined value. A gas ballast may also be delivered to the high-vacuum stage of the pump when the pressure difference exceeds this predetermined value. The apparatus may include a diaphragm valve including a diaphragm mounted between subchambers that are respectively in fluid communication with the intake and discharge regions of the high-vacuum stage of the pump. When the pressure differential between the intake and discharge regions, and thus the subchambers, reaches a predetermined level, the diaphragm is distended to a sufficient degree to unseat a valve element, which allows increased quantities of oil to be delivered to the high-vacuum stage of the pump.

9 Claims, 2 Drawing Sheets

METHOD AND APPARATUS FOR DELIVERING OIL TO A MULTI-STAGE PUMP

TECHNICAL FIELD

The invention is directed to a method and apparatus for delivering oil into the pump chamber of a high-vacuum stage of a multiple stage, oil-lubricated vacuum-pump.

BACKGROUND OF THE INVENTION

It is a standard practice, in operating oil-lubricated vacuum-pumps, to introduce a predetermined quantity of oil or other lubricant into the pump chamber at the beginning of each compression cycle. The oil performs several functions. First, the oil serves to lubricate the component parts of the vacuum-pump that come into contact with one another. Second, the oil provides a corrosion-resistant coating on interior surfaces of the pump. Third, the oil stream acts as a medium for ridding the pump both of chemical and particulate impurities, and of heat, i.e. of cleansing the pump chamber and cooling the pump. Finally, the oil serves to improve the seal between the intake and discharge regions of the pump.

Each of these functions may require a different quantity of oil. Thus, the determination of the quantity of oil to be introduced in the pump chamber before each compression event is necessarily based on a compromise between the quantities required for the respective oil functions.

Furthermore, it is known that the oil requirements of a vacuum-pump vary under different operating conditions. For example, larger quantities of oil are required during the initial operating stages of the pump, in which output is high, than are required in subsequent operating stages, which have lower outputs. Optimally, the oil should perform each of its designated functions under a wide range of operating conditions.

DE-AS 11 79 666 discloses a single-stage rotary-piston vacuum pump provided with a control mechanism that actuates a supplemental oil feed. The control mechanism is responsive to pressure in the compression space of the pump chamber. The pressure in the pump chamber is above atmospheric pressure during high output pump stages (e.g. during pump start-up), and below atmospheric pressure during low output stages (also referred to as the "ultimate pressure mode"). The supplemental oil feed is controlled by means of a piston that is actuated by pressure variation in the pump chamber, and admits greater quantities of oil into the pump chamber during high pressure operational stages.

This type of supplemental oil feed is unsuitable for use with a high-vacuum stage of a multi-stage vacuum pump, due to its lack of operational precision, and furthermore since its operation is dependent solely upon output pressure.

In modern vacuum-pumps, discharge pressure alone is an inadequate indicator for triggering lubrication. For example, elevated discharge pressure may occur when downstream oil filters are overloaded with filtrate. Known supplemental oilers have no way of recognizing such a condition. If this condition were to occur during the ultimate pressure mode, increased quantities of oil would flow into the pump chamber during pump operational stages that actually require smaller quantities of oil. Such over-supply of oil is undesirable, since it may interfere with pump operation.

It is therefore apparent that a need exists for a method and apparatus for delivering oil into a pump chamber of a high vacuum stage of a multi-stage pump which provides a precise, operationally dependent delivery of oil.

SUMMARY OF THE INVENTION

The present invention provides a method and apparatus for delivering oil into a pump chamber of a high-vacuum stage of a multi-stage pump in which a constant oil delivery is present that is sufficient for operation of the high-vacuum stage in the ultimate pressure range. Additional oil is let into the pump chamber when the difference between the pressures of the intake region of the pump and the discharge region of the pump exceeds a predetermined value. This ensures that lesser quantities of oil are delivered during low pressure operational stages, thus ensuring economical lubrication in the ultimate pressure range. When the pressure difference between the intake region and the discharge region of the high-vacuum stage exceeds a predetermined value characteristic of the particular pump, delivery of additional oil begins, thus ensuring that improved lubrication, cooling, cleansing, and sealing of the high-vacuum stage are maintained, thereby improving pump performance and extending the operational life of the pump.

The present invention includes a method of delivering oil into a pump chamber of a high-vacuum stage of a multi-stage pump. The method includes the steps of sensing a first pressure at an intake region of the high-vacuum stage of the pump, and sensing a second pressure at a discharge region of the high-vacuum stage of the pump. Oil is delivered to the high-vacuum stage of the pump in response to a pressure difference between the first and second pressures. Increased quantities of oil are delivered to the high-vacuum stage of the pump when the pressure difference exceeds a predetermined value, which may be in the range of approximately 10 to 30 mbar.

A gas ballast may also be delivered to the high-vacuum stage of the pump when the pressure difference exceeds this predetermined value.

The invention includes an apparatus for practicing the above described method. In one embodiment, pressure sensors may be operatively connected at the intake and discharge regions of the high-vacuum stage of the pump, and oil delivery valves may be controlled from a central electronic control system.

In another embodiment, additional oil may be delivered through a diaphragm valve. Specifically, the diaphragm valve may include a housing that surrounds a diaphragm chamber which is divided into first and second subchambers by a diaphragm. A first connecting line provides fluid pressure communication between the first subchamber and the intake region of the high-vacuum stage of the pump. A second line provides fluid pressure communication between the second subchamber and the discharge region of the high-vacuum stage of the pump. A passage is provided in the housing through which oil may flow between an inlet port attachable to a source of pressurized oil, and an outlet port attachable to the pump chamber of the high vacuum pump. A valve element attached to the diaphragm selectively blocks the flow of oil from the inlet to the outlet of the passage.

The diaphragm valve may include an actuation rod having a first end secured to the diaphragm, and a second end secured to the valve element. The valve housing may be constructed from three separate housing sections that cooperate to form the various chambers and passages.

The invention provides diaphragm valves that are economical to manufacture and to operate. The force required for actuating the valves is relatively low, so that the effect on overall pump efficiency is minimized. The invention thus provides a precisely controlled lubrication that is dependent on pump operation, and that has a sensitive switching threshold. The precise opening point for the valves can be matched to the requirements of individual pumps by selecting diaphragms with the appropriate properties (size, flexibility, etc.).

Since the control mechanism of the invention is responsive to vacuum pressure, the invention may be adapted to various operating parameters of the pump. It is therefore possible to admit gas ballast into the high-vacuum stage of the pump during high pressure operation, when the risk of condensation of the conveyed gas within the pump is particularly high. The sensitive control mechanism of the present invention recognizes such operational stages immediately, and affects increased oil delivery in conjunction with the introduction of gas ballast.

Other objects and advantages of the present invention will become apparent upon reference to the accompanying description when taken in conjunction with the following drawings.

DESCRIPTION OF THE PREFERRED EMBODIMENT

Figure 1:
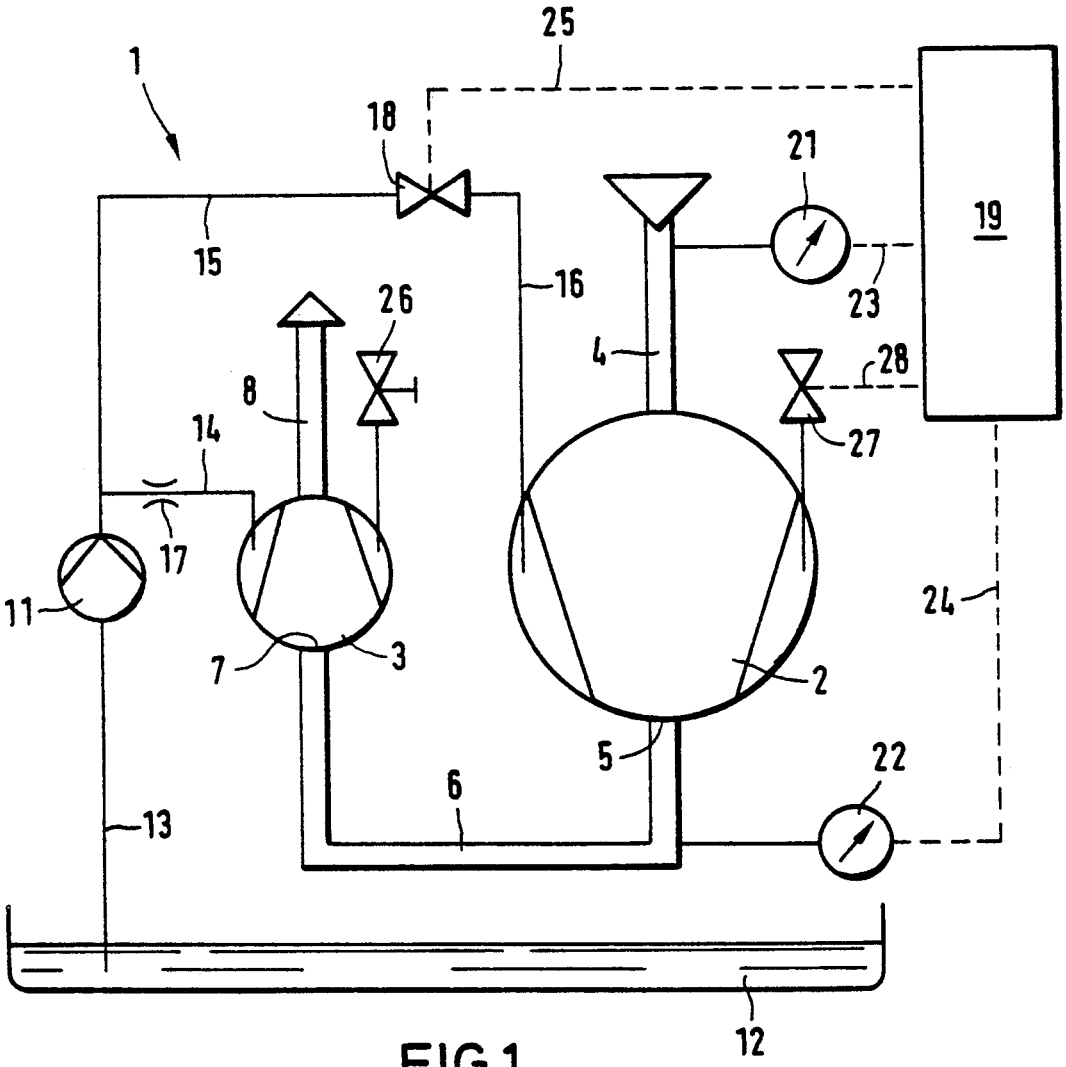
FIG. 1 is a schematic diagram of a two-stage vacuum-pump embodying the present invention.

FIG. 1 shows a two-stage vacuum-pump 1 having a high-vacuum stage 2 and a fore-pressure stage 3. A vessel to be evacuated (not shown) is connected to the intake 4 of the high-vacuum stage 2 during operation of the vacuum-pump. The discharge region 5 of the high-vacuum stage 2 is connected to the intake 7 of the fore-pressure stage 3 via a line 6. The fore-pressure stage 3 includes a discharge region 8.

An oil pump 11 conveys oil from an oil sump 12 through line sections 13, 14, 15, and 16 to the pump stages 2 and 3. The quantity of oil supplied to the fore-pressure stage may be held constant, for example by a restrictor 17 in the line section 14. A valve 18 is provided between line sections 15 and 16. The valve 18 is controlled by the control mechanism 19.

The control mechanism 19 includes a pressure sensor 21 connected to the intake region 4 of the high-vacuum stage 2, and a pressure sensor 22 connected to the discharge region 5 of the high pressure stage 2. Output from the pressure sensors 21 and 22 is connected to the control mechanism 19 by means of lines 23 and 24. If the pressure sensors 21 and 22 are electronically operated, the lines 23 and 24 may be used to convey electrical signals generated by the pressure sensors to the control mechanism 19. The control mechanism 19, which may, for example, be a microprocessor, computes the difference between the intake and discharge pressures, and compares this difference to a predetermined value. For example, in a two-stage vacuum-pump having a pump ratio of 4:1, it would be desirable to increase lubrication when the pressure difference was in a range between 10 and 30 mbar. When the sensed pressure difference exceeds the predetermined value, the control mechanism 19 sends a signal through the line 25 to open the valve 18. As soon as the measured pressure difference falls below the predetermined value, the valve 18 closes, so that the high-vacuum stage 2 is operated with economical lubrication at its ultimate pressure range. During low-pressure operation, the quantity of oil that enters the pump chamber of the high-vacuum stage 2 through the bearings of the rotary shaft is sufficient.

A valve 26 serves to admit gas ballast into the fore-pressure stage 3, and a valve 27 admits gas ballast into the high-vacuum stage 2 of the pump 1. The admission of gas ballast into the high-vacuum stage 2 can be automatically controlled in response to the difference between the pressures of the intake region and discharge region of the high-vacuum stage 2. In order to accomplish this, the valve 27 is connected to the control mechanism 19 via a control line 28, and the valve 27 can be operated in a fashion similar to the oil admission valve 18. Irrespective of whether the opening of the valve 27 is accomplished automatically or manually, the supply of additional oil through the valve 18 should be responsive to the operating condition of the high-vacuum stage, as described above.

Figure 2:
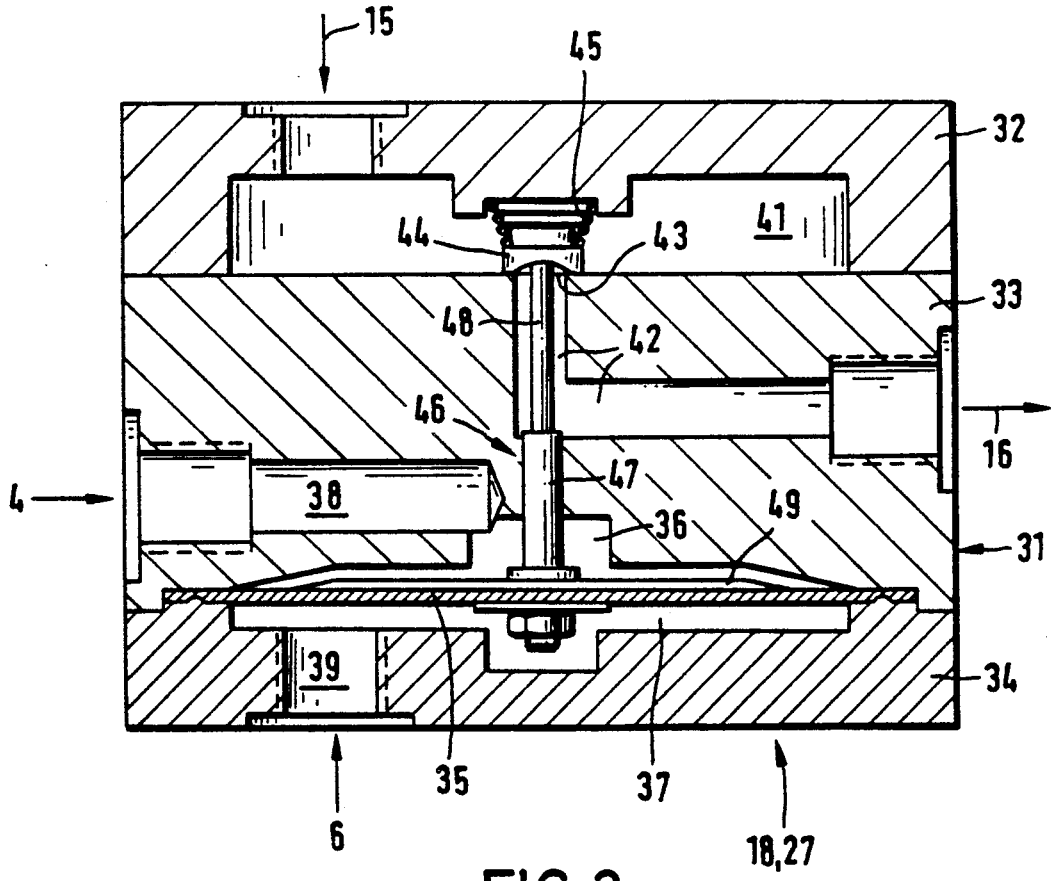
FIG. 2 is a sectional view of a diaphragm valve forming a part of the present invention.

FIG. 2 shows an exemplary embodiment of a mechanical control valve forming a part of the present invention. The valve 18 for the delivery of additional oil and the valve 27 for the delivery of gas ballast into the high-vacuum stage 2 can be provided in the form illustrated in FIG. 2. Thus, a pressure responsive diaphragm valve could be substituted for the control assembly shown in FIG. 1.

The valve shown in FIG. 2 includes a valve housing 31 that is formed from three housing sections 32, 33, and 34. A diaphragm 35 is clamped between the housing section 33 and 34. The diaphragm 35 separates the diaphragm chamber into a first subchamber 36 extending into the housing section 33, and a second subchamber 37 extending into the housing 34. A connecting line in the form of a bore 38 leads from the subchamber 36 and is in fluid pressure communication with the intake region 4 of the high-vacuum pump stage 2. A second connecting line 39, also in the form of a bore, provides fluid pressure communication between the second subchamber 37 and the discharge region 5 of the high-vacuum pump stage 2.

An oil flow passage includes an inlet port leading into a chamber 41, which leads to a channel 42 terminating at an outlet port. The chamber 41 is connected to a source of pressurized oil via the line 15, and is formed in the first housing section 32. Oil from the oil pump 11 is delivered to the chamber 41 by the line 15 at a pressure which may, for example, occur in a range of about 1.5 through 1.8 bar. The channel 42 is formed in the second housing section 33, and is connected to a line 16 that leads to the high-vacuum stage 2.

A valve seat 43 is formed on the housing section 33 at the entrance to the passage 42. A valve element 44 is urged towards the valve seat 43 by a compression spring 45, and is acted upon by the diaphragm 35 through an actuation rod 46. Although the spring 45 is shown as a coil spring, it is also contemplated that a leaf-spring of other resilient member could be provided, as long as the spring member 45 is chosen so that its biasing force is relatively small compared to the pressure of the oil in the chamber 41. The actuation rod 46 associated with the diaphragm 35 includes an increased diameter section 47 that is received in a passage formed in the housing section 33, in order to provide a substantially fluid-tight seal between the passage 42 and the subchamber 36. A reduced-diameter section 48 passes through the channel 42, and is attached to the valve element 44.

In operation, when the pressures at the intake region 4 and the discharge region 5 of the high-vacuum stage 2 are approximately equal or only slightly different, the pressures in the subchambers 36 and 37 are likewise the same or only slightly different, and the diaphragm 35 assumes the position shown in FIG. 2. In this position, the valve element 44 is sealingly engaged with the valve seat 43, so that no oil can flow from chamber 41 to the passage 42. However, when the pressure in the subchamber 37 exceeds the pressure in the subchamber 36 by a predetermined amount (dependent upon the physical characteristics of the diaphragm 35), the diaphragm 35 is distended upwardly, thus effecting movement of the actuation rod 46, and causing the valve element 44 to be lifted from the valve seat 43. Oil from the chamber 41 then passes through the channel 42 and the line 16, and proceeds into the high-vacuum stage 2 as an auxiliary oil supply. In this way, the diaphragm 35 "senses" the respective intake and discharge pressures, and actuates the valve accordingly.

As a safeguard against potential damage to the diaphragm 35 which might occur with excessively high intake/discharge pressure differentials, these extend into the housing section 33 only far enough to allow displacement of the valve element 44. When the subchamber 37 is exposed to extremely high pressures, the diaphragm 35 or the diaphragm plate 49 presses against the inside wall of the subchamber 36, thus preventing rupture of the diaphragm 35 due to excessive distention.

Although the present invention has been described with reference to a specific embodiment, those of skill in the art will recognize that changes may be made thereto without departing from the scope and spirit of the invention as set forth in the appended claims.

We claim as our invention:

1. A method of delivering oil into a pump chamber of a high-vacuum stage of a multi-stage pump, said method comprising the following steps:

sensing a first pressure at an intake region of said high-vacuum stage of said pump;

sensing a second pressure at a discharge region of said high vacuum stage of said pump;

sensing a pressure difference between said first and second pressures;

delivering oil to said high-vacuum stage of said pump in response to said pressure different; and delivering increased quantities of oil to said high-vacuum stage of said pump when said pressure difference exceeds a predetermined value;

wherein said predetermined value is in a range of approximately 10 to 30 mbar.

2. A method according to claim 1, further comprising the step of selectively supplying a gas ballast to said high-vacuum stage of said pump.

3. A method according to claim 2, wherein said gas ballast is supplied to said high-vacuum stage of said pump when said pressure difference exceeds said predetermined value.

4. An apparatus for delivering oil into a pump chamber of a high-vacuum stage of multi-stage pump, said apparatus comprising the following:

means for sensing a first pressure at an intake region of said high-vacuum stage of said pump, sensing a second pressure at a discharge region of said high-vacuum stage of said pump and sensing a pressure difference between said first and second pressures; and means for delivering oil to said high-vacuum stage of said pump in response to said pressure different, and for delivering increased quantities of oil to said high-vacuum stage of said pump when said pressure difference exceeds a predetermined value;

wherein said means for sensing and said means for delivering are components of a diaphragm valve assembly, said diaphragm valve assembly including a housing surrounding a diaphragm chamber, a diaphragm dividing said chamber into a first subchamber and a second subchambers, a first connecting line providing fluid pressure communication between said first subchamber and said intake region of said high-vacuum stage of said pump; and a second connecting line providing fluid pressure communication between said second subchamber and said discharge region of said high-vacuum stage of said pump.

5. An apparatus according to claim 4, wherein said means for sensing comprises pressure sensors operatively connected to an electronic control system.

6. An apparatus according to claim 4, wherein said diaphragm valve further comprises the following:

passage means, in said housing, for facilitating a flow of oil between an inlet port adapted and constructed to receive oil from a source of pressurized oil, and an outlet port adapted and constructed for attachment to said pump chamber of said high-vacuum pump; and valve element means, disposed in said passage, for selectively blocking said flow of oil.

7. An apparatus according to claim 6, wherein said diaphragm valve further comprises an actuation rod having a first end secured to said diaphragm, and a second end secured to said valve means.

8. In an apparatus for delivering oil into a pump chamber of a high-vacuum stage of a multi-stage pump, a diaphragm valve comprising the following:

a housing including first, second, and third housing sections;

an oil flow passage formed between said first and second housing sections, said oil flow passage including an oil inlet port in said first housing section adapted for connection to a source of pressurized oil, an oil outlet port in said second housing section adapted for connection to said high-vacuum stage of said multistage pump, and a valve seat on said second housing section;

a diaphragm chamber formed between said second and third housing sections;

a diaphragm clamped between said second and third housing sections and dividing said chamber into a first subchamber extending into said second housing section, and a second subchamber extending into said third housing section;

valve means, secured to said diaphragm and selectively engageable with said valve seat, for selectively blocking said oil flow passage;

a first connecting line, formed in said second housing section, providing fluid pressure communication between said first subchamber and an intake region of said high-vacuum stage of said pump; and a second connecting line, formed in said third housing section, providing fluid pressure communication between said second subchamber and a discharge region of said high-vacuum stage of said pump.

9. A diaphragm valve according to claim 8, wherein said first subchamber comprises means for limiting distension of said diaphragm.

* * * * *